US005230980A

United States Patent [19]

Maniar

[11] Patent Number: 5,230,980

[45] Date of Patent: Jul. 27, 1993

[54] TREATING CARRIER PARTICLES WITH COATINGS CONTAINING CHARGE ENHANCING ADDITIVES

[75] Inventor: Deepak R. Maniar, Penfield, N.Y.

[73] Assignee: Xerox Corporation, Stamford, Conn.

[21] Appl. No.: 737,290

[22] Filed: Jul. 29, 1991

Related U.S. Application Data

[62] Division of Ser. No. 457,123, Dec. 26, 1989, Pat. No. 5,071,726.

[51] Int. Cl.[5] ..... G03G 9/097; G03G 9/113

[52] U.S. Cl. ..... 430/137; 430/108

[58] Field of Search ..... 430/108, 137

[56] References Cited

U.S. PATENT DOCUMENTS 4,935,326 6/1990 Creatura et al. ..... 430/108

FOREIGN PATENT DOCUMENTS 191650 11/1982 Japan ..... 430/108
188659 10/1984 Japan ..... 430/108
258262 11/1986 Japan ..... 430/108
258267 11/1986 Japan ..... 430/108
29859 1/1989 Japan ..... 430/108

*Primary Examiner*—Roland Martin
*Attorney, Agent, or Firm*—John L. Haack; Eugene O. Palazzo

[57] ABSTRACT

A carrier composition comprised of a core with a coating thereover comprised of a mixture of first and second polymers that are not in close proximity thereto in the triboelectric series, which mixture contains a charge enhancing additive.

12 Claims, 2 Drawing Sheets

TREATING CARRIER PARTICLES WITH COATINGS CONTAINING CHARGE ENHANCING ADDITIVES

This is a division of application Ser. No. 457,123, filed Dec. 26, 1989, now U.S. Pat. No. 5,071,726.

BACKGROUND OF THE INVENTION

This invention is generally directed to developer compositions, and more specifically, the present invention relates to developer compositions with treated or preconditioned coated carrier particles prepared, for example, by a dry powder process. In one embodiment of the present invention, the carrier particles are comprised of a core with coating thereover generated from a mixture of polymers that are not in close proximity thereto in the triboelectric series, which coating contains a charge enhancing additive such as distearyl dimethyl ammonium methyl sulfate, reference U.S. Pat. No. 4,560,635, the disclosure of which is totally incorporated herein by reference. Moreover, in another aspect of the present invention the carrier particles are prepared by a dry coating process wherein a polymer or a mixture of polymers are applied to a carrier core enabling insulating particles with relatively constant conductivity parameters; and also wherein the triboelectric charge on the carrier can vary significantly depending on the coatings selected, which coatings are preconditioned with a charge enhancing additive by the mixing thereof with the coating or coatings selected. Developer compositions comprised of the preconditioned carrier particles of the present invention are useful in electrostatographic or electrophotographic imaging systems, especially xerographic imaging processes. Additionally, developer compositions comprised of substantially insulating carrier particles prepared in accordance with the process of the present invention are useful in imaging methods wherein relatively constant conductivity parameters are desired. Furthermore, in the aforementioned imaging processes the triboelectric charge on the carrier particles can be preselected depending on the polymer composition applied to the carrier core. Also, with the preconditioned carriers the admix characteristics of the developer, especially the toner selected is, for example, from about 15 to about 60, and preferably from about 15 to about 30 seconds. Further changes in At, that is the triboelectric values of the carrier particles are substantially constant. Further, stable triboelectric charge characteristics and admix times for added substantially uncharged toner is less than 60 seconds in many embodiments of the present invention.

The aforementioned $A_t$ refers to the tribo (toner concentration + 1) and with the present invention it is this $A_t$ that is relatively constant in most embodiments thus enabling a number of advantages with the developer composition of the present invention. In one embodiment, the $A_t$ for the developers of the present invention can be from about 55 to about 115 and preferably is from about 90 to about 95, reference FIG. 3, for example.

The electrostatographic process, and particularly the xerographic process, is well known. This process involves the formation of an electrostatic latent image on a photoreceptor, followed by development, and subsequent transfer of the image to a suitable substrate. Numerous different types of xerographic imaging processes are known wherein, for example, insulative developer particles or conductive toner compositions are selected depending on the development systems used. Moreover, of importance with respect to the aforementioned developer compositions is the appropriate triboelectric charging values associated therewith, as it is these values that enable continued constant developed images of high quality and excellent resolution, and the admix characteristics together with a stable $A_t$. The aforementioned characteristics are achieved with the present invention.

In a patentability search report, the following prior art, all U.S. patents, were recited: U.S. Pat. No. 4,803,017 directed to new quaternary ammonium salts as charge control agents in electrophotographic toners and developers, see the Abstract of the Disclosure, for example, and wherein it is disclosed, reference column 2 for example, beginning at line 60, that additionally some of the known quaternary ammonium salt charge agents would adversely interact chemically and/or physically with other developer or copier components, for example, some interact with carrier or carrier coating materials; U.S. Pat. No. 4,812,378 directed to toners with charge control agents of quaternary ammonium salts, and also note column 2, beginning at line 62, wherein it is indicated that additionally some of the known quaternary ammonium salt charge control agents will adversely interact chemically and/or physically with other developer copier components, for example some interact with carrier or carrier coating material; similar teachings are present in U.S. Pat. Nos. 4,812,380 and 4,812,382; U.S. Pat. No. 4,726,994 directed to a method of modifying the triboelectric charging propensity of carrier particles coated with a fluorohydrocarbon polymer, which comprises dehydrofluorinating and oxidizing the polymer by contacting the coated particles with a basic solution and the solution of an oxidizing agent, reference for example the Abstract of the Disclosure, with a similar teaching being present in U.S. Pat. No. 4,737,435; U.S. Pat. No. 4,672,016 directed to carrier particles with a carrier core containing a silicone resin layer thereon, the silicone resin layer containing an organic tin compound and finely divided electroconductive particles, reference the Abstract of the Disclosure and note the teachings in columns 1, 2, 3, 4 and 5; and as background or collateral interest U.S. Pat. No. 3,985,663 directed to conductive inks containing quaternary ammonium compounds, see for example the Abstract of the Disclosure; and U.S. Pat. No. 4,560,635 directed to toner compositions with ammonium sulfate charge enhancing additives, reference for example the Abstract of the Disclosure.

Additionally, carrier particles for use in the development of electrostatic latent images are described in many patents including, for example U.S. Pat. No. 3,590,000. These carrier particles may consist of various cores, including steel, with a coating thereover of fluoropolymers; and terpolymers of styrene, methacrylate, and silane compounds. Recent efforts have focused on the attainment of coatings for carrier particles for the purpose of improving development quality; and also to permit particles that can be recycled, and that do not adversely effect the imaging member in any substantial manner. Some of the present coatings can deteriorate rapidly, especially when selected for a continuous xerographic process where the entire coating may separate from the carrier core in the form of chips or flakes, and fail upon impact or abrasive contact with machine parts and other carrier particles. These flakes or chips, which cannot generally be reclaimed from the developer mixture, have an adverse effect on the triboelectric charging characteristics of the carrier particles thereby providing images with lower resolution in comparison to those compositions wherein the carrier coatings are retained on the surface of the core substrate. Further, another problem encountered with some prior art carrier coatings resides in fluctuating triboelectric charging characteristics, particularly with changes in relative humidity. The aforementioned modification in triboelectric charging characteristics provides developed images of lower quality, and with background deposits.

There are also illustrated in U.S. Pat. No. 4,233,387, the disclosure of which is totally incorporated herein by reference, coated carrier components for electrostatographic developer mixtures comprised of finely divided toner particles clinging to the surface of the carrier particles. Specifically, there is disclosed in this patent coated carrier particles obtained by mixing carrier core particles of an average diameter of from between about 30 microns to about 1,000 microns with from about 0.05 percent to about 3.0 percent by weight, based on the weight of the coated carrier particles, of thermoplastic resin particles. The resulting mixture is then dry blended until the thermoplastic resin particles adhere to the carrier core by mechanical impaction and/or electrostatic attraction. Thereafter, the mixture is heated to a temperature of from about 320° F. to about 650° F. for a period of 20 minutes to about 120 minutes, enabling the thermoplastic resin particles to melt and fuse on the carrier core. While the developer and carrier particles prepared in accordance with the process of this patent are suitable for their intended purposes, the conductivity values of the resulting particles are not constant in all instances, for example, when a change in carrier coating weight is accomplished to achieve a modification of the triboelectric charging characteristics; and further with regard to the '387 patent, in many situations carrier and developer mixtures with only specific triboelectric charging values can be generated when certain conductivity values or characteristics are contemplated. With the invention of the present application, in an embodiment thereof the conductivity of the resulting carrier particles are substantially constant, and moreover the triboelectric values can be selected to vary significantly, for example, from less than −15 microcoulombs per gram to greater than −70 microcoulombs per gram, depending on the polymer mixture selected for affecting the coating process.

Other patents of interest include U.S. Pat. No. 3,939,086, which teaches steel carrier beads with polyethylene coatings, see column 6; U.S. Pat. No. 4,264,697, which discloses dry coating and fusing processes; U.S. Pat. Nos. 3,533,835; 3,658,500; 3,798,167; 3,918,968; 3,922,382; 4,238,558; 4,310,611; 4,397,935 and 4,434,220. Also, it is known to treat carrier particles with metal salts of fatty acids such as zinc stearate to permit, for example, improved flowability of the toner polymer present on the surface of the carrier.

With further reference to the prior art, carriers obtained by applying insulating resinous coatings to porous metallic carrier cores using solution coating techniques are undesirable from many viewpoints. For example, the coating material will usually reside in the pores of the carrier cores, rather than at the surfaces thereof; and therefore is not available for triboelectric charging when the coated carrier particles are mixed with finely divided toner particles. Attempts to resolve this problem by increasing the carrier coating weights, for example, to as much as 3 percent or greater to provide an effective triboelectric coating to the carrier particles necessarily involves handling excessive quantities of solvents, and further usually these processes result in low product yields. Also, solution coated carrier particles when combined and mixed with finely divided toner particles provide in some instances triboelectric charging values which are too low for many uses. The powder coating process that may be selected for the present invention in an embodiment thereof overcomes or minimizes these disadvantages; enables developer mixtures that are capable of generating high and useful triboelectric charging values with finely divided toner particles; and also wherein the carrier particles are of substantially constant conductivity. Further, when the preconditioned resin coated carrier particles are prepared by the powder coating process of the present invention, the majority of the coating materials are fused to the carrier surface thereby reducing the number of toner impaction sites on the carrier material. Additionally, there can be achieved with the process of the present invention, independent of one another, desirable triboelectric charging characteristics and conductivity values; that is, for example, the triboelectric charging parameter is not dependent on the carrier coating weight as is believed to be the situation with the process of U.S. Pat. No. 4,233,387 wherein an increase in coating weight on the carrier particles may function to also permit an increase in the triboelectric charging characteristics. Specifically, therefore, with the carrier compositions and process of the present invention there can be formulated developers with selected triboelectric charging characteristics and/or conductivity values in a number of different combinations.

Thus, for example, there can be formulated in accordance with the invention of the present application developers in an embodiment thereof with conductivities of from about $10^{-6}$ mho $(cm)^{-1}$ to about $10^{-17}$ mho $(cm)^{-1}$ as determined in a magnetic brush conducting cell; and triboelectric charging values of from about a −8 to a −80 microcoulombs per gram on the carrier particles as determined by the known Faraday Cage technique. Thus, the developers of the present invention can be formulated with constant conductivity values with different triboelectric charging characteristics by, for example, maintaining the same coating weight on the carrier particles and changing the polymer coating ratios. Similarly, there can be formulated developer compositions wherein constant triboelectric charging values are achieved and the conductivities are altered by retaining the polymer ratio coating constant and modifying the coating weight for the carrier particles. Also of importance with respect to the present invention is the process of preconditioning the carrier core and/or carrier coating with charge enhancing additive thereby permitting desirable admix characteristics, preferably of from about 15 to about 30 seconds, and stable $A_t$.

Disclosed in U.S. Pat. Nos. 4,937,166 and 4,935,326, the disclosures of which are totally incorporated herein by reference, are developers containing carrier particles with polymeric coatings not in close proximity in the triboelectric series. More specifically, these patents disclose carrier particles prepared by dry mixing low density porous magnetic or magnetically attractable metal core carrier particles with from, for example, between about 0.05 percent and about 3 percent by weight, based on the weight of the coated carrier particles, of a mixture of polymers until adherence thereof to the carrier core by mechanical impaction or electrostatic attraction; heating the mixture of carrier core particles and polymers to a temperature, for example, of between from about 200° F. to about 550° F. for a period of from about 10 minutes to about 60 minutes enabling the polymers to melt and fuse to the carrier core particles; cooling the coated carrier particles; and thereafter classifying the obtained carrier particles to a desired particle size. In a specific embodiment of the aforementioned copending applications, there are disclosed carrier particles comprised of a core with a coating thereover comprised of a mixture of a first dry polymer component and a second dry polymer component, which are not in close proximity in the triboelectric series. Therefore, the aforementioned carrier compositions, which can be selected for the compositions of the present invention in an embodiment, can be comprised of known core materials including iron with a dry polymer coating mixture thereover. Subsequently, developer compositions can be generated by admixing the aforementioned carrier particles with a toner composition comprised of resin particles and pigment particles. With the carriers of the aforementioned applications, there can be obtained stable triboelectric properties independent of conductivity, and stable conductivity characteristics independent of the triboelectric charge of the toner.

SUMMARY OF THE INVENTION

It is an object of the present invention to provide toner and developer compositions with preconditioned carrier particles containing a polymer or polymer mixture coating, and processes for the preparation thereof.

In another object of the present invention there are provided dry coating processes for generating developer particles with excellent admix characteristics.

In yet another object of the present invention there are provided dry coating processes for generating carrier particles of substantially constant conductivity parameters, and a wide range of preselected triboelectric charging values.

In yet a further object of the present invention there are provided carrier particles comprised of a preconditioned coating with a mixture of polymers that are not in close proximity, that is for example a mixture of polymers from different positions in the triboelectric series.

In still a further object of the present invention there are provided treated carrier particles of insulating characteristics comprised of a core with a coating thereover generated from a mixture of polymers.

Further, in an additional object of the present invention there are provided treated carrier particles comprised of a core with a coating thereover generated from a mixture of polymers wherein the triboelectric charging values are from about −10 microcoulombs to about −70 microcoulombs per gram at the same coating weight.

In another object of the present invention there are provided methods for the development of electrostatic latent images wherein the developer mixture comprises treated carrier particles with a coating thereover comprised of a mixture of polymers that are not in close proximity in the triboelectric series.

Also, in another object of the present invention there are provided positively charged toner compositions, or negatively charged toner compositions having incorporated therein treated carrier particles with a coating thereover of a mixture of certain polymers.

Moreover, in another object of the present invention there are provided developer compositions comprised of carrier compositions with coatings thereover, which coatings have initially dispersed therein charge enhancing additives enabling, for example, a number of advantages including a stable $A_t$.

In yet another object of the present invention there are provided developer compositions comprised of toner compositions and carrier particles, and wherein freshly uncharged replenishment toner being added to the developer has rapid admix characteristics, for example less than 60 seconds and preferably from about 15 to about 60 seconds in some embodiments.

These and other objects of the present invention are accomplished by providing developer compositions comprised of toner particles, and preconditioned carrier particles prepared by a powder coating process; and wherein the carrier particles are comprised of a core with a coating thereover comprised of a mixture of polymers containing charge enhancing additives. More specifically, the carrier particles selected can be prepared by mixing low density porous magnetic or magnetically attractable metal core carrier particles with from, for example, between about 0.05 percent and about 3 percent by weight, based on the weight of the coated carrier particles, of a mixture of polymers until adherence thereof to the carrier core by mechanical impaction or electrostatic attraction, and charge enhancing additives; heating the mixture of, for example, carrier core particles and polymers to a temperature, for example, of between from about 200° F. to about 550° F. for a period of from about 10 minutes to about 60 minutes enabling the polymers to melt and fuse to the carrier core particles; cooling the coated carrier particles; and thereafter classifying the obtained carrier particles to a desired particle size. There results on the carrier coating or partially dispersed therein the charge enhancing additive. With the aforementioned treated carriers, there are obtained, for example, desirable toner admix characteristics, especially when from about 0.002 to about 0.2 weight percent of charge additive is selected.

In an embodiment of the present invention, there are provided carrier particles comprised of a core with a coating thereover comprised of a mixture of a first dry polymer component and a second dry polymer component, which are not in close proximity in the triboelectric series, which coating is preconditioned with a charge enhancing additive by mixing together in a blender, such as Littleford M5G blender, for an effective period of time, for example from about 2 to about 10 minutes, and preferably from about 4 to about 6 minutes, the aforementioned components wherein the polymers are preferably comprised of a first polymer of polyvinylidiene fluoride (Kynar), and a second polymer of polymethylmethacrylate thereby permitting a homogeneous mixture thereof. The aforementioned blender thus contains a premix of a first polymer such as Kynar in an amount of from about 10 to about 90 weight percent, a second polymer such as polymethylmethacrylate in the amount of from about 90 to about 10 weight percent and a charge enhancing additive in an amount of from about 0.003 to about 0.02, and preferably from about 0.003 to about 0.05, and more preferably about 0.01 weight percent, which charge enhancing additive is initially dispersed in the aforementioned polymeric coating. A typical effective amount of the resulting premix, for example from about 0.1 to about 1.0 and preferably about 0.7 weight percent based on the weight of the core is that mixed with the carrier core. More specifically, from about 100 to about 200 pounds, and preferably 150 pounds of carrier core component, such as steel, is added with the aforementioned premix in an effective amount to a mixer, such as a Munson blender, wherein further mixing is accomplished for an effective period of time of, for example, from about 10 to about 120 minutes and preferably from about 30 to about 60 minutes. Thereafter, the aforementioned resulting mixture is fed into one end of an apparatus such as a known rotary kiln, and discharged from the opposite end, which apparatus in a preferred embodiment is 7 inches in diameter and is generally comprised of steel with the feed rate to the kiln being from about 300 to 600 grams per minute, and preferably 400 grams per minute, and wherein the temperature of the kiln is maintained at from about 350° to about 450° F. and preferably from about 360° to about 400° F. Heating (the residence time) is accomplished for from about 10 to about 120 minutes and preferably from about 20 to 40 minutes. After cooling, the resulting mixture is discharged on to a screen separator, such a Sweeco Screen Separator, for the purpose of removing large particles, for example those particles with an average diameter of greater than 200 microns to provide carrier particles with an average weight median size of from about 40 to about 220 microns, and preferably from about 120 to about 130 microns in an embodiment of the present invention. The rotary kiln's primary purpose is to enable fusing of the polymer mixture to the carrier core. The aforementioned carrier compositions can be comprised of known core materials including iron with a dry polymer coating mixture thereover, which coating contains a charge enhancing additive. Subsequently, developer compositions can be generated by admixing the aforementioned carrier particles with a toner composition comprised of resin particles, pigment particles, and optional charge enhancing additives.

In a specific embodiment, a premixture is prepared by mixing in a high intensity blender for an effective period of time of, for example, 4 minutes a polymer mixture coating, 0.7 coating weight percent, preferably comprised of Kynar, 40 weight percent, and polymethylmethacrylate 60 weight percent, with a charge additive such as distearyl dimethyl ammonium methyl sulfate in an amount of 0.005 weight percent. Thereafter, about 150 pounds of a carrier core comprised, for example, of steel is mixed with the aforementioned mixture, 476 grams, for about 30 minutes in a Munsen mixer. The mixture resulting is then processed in a rotary kiln as illustrated herein.

BRIEF DESCRIPTION OF THE DRAWINGS

For a better understanding of the present invention, further features thereof and comparative aspects, reference is made to the following detailed description wherein.

DETAILED DESCRIPTION OF THE DRAWINGS

Figure 1:
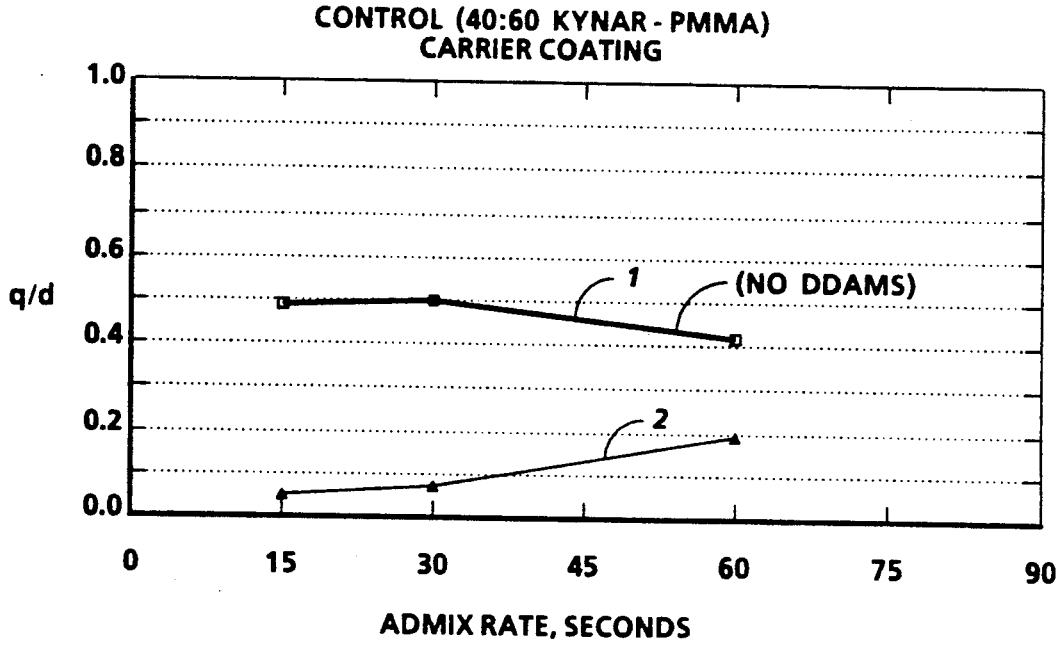
FIGS. 1 and 2 are line graphs of admix rate in seconds versus q/d.

There is represented in FIG. 1 a graph detailing the admix time in seconds versus q/d with q representing toner tribocharge, and d the toner diameter particle size, wherein q/d is automatically determined in a known charge spectagraph. Line 1 represents the admix time or rate for a developer (toner plus carrier) containing a carrier with a steel core with a polymer thereover of 40 percent by weight of Kynar and 60 percent by weight of polymethyl methacrylate, 0.7 percent coating weight, (0.7×40; 0.7×60) and wherein the coating does not contain any charge enhancing additive, reference line 1. Line 2 represents admix rates for a substantially uncharged toner composition that is added to the developer composition of line 1. The toner composition in each instance with reference to FIG. 1, lines 1 and 2, is comprised of 80.13 percent of a suspension polymerized styrene butadiene; 3.15 percent by weight of carbon black particles, 16.4 weight percent of magnetite; and 0.32 weight percent of the charge enhancing additive distearyl dimethyl ammonium methyl sulfate. The developer of line 1, FIG. 1, is comprised of 3 parts per weight (3 percent toner concentration) of the aforementioned toner per 100 parts by weight of the indicated carrier with the polymer mixture thereover and no charge enhancing additive in the carrier coating.

Figure 2:
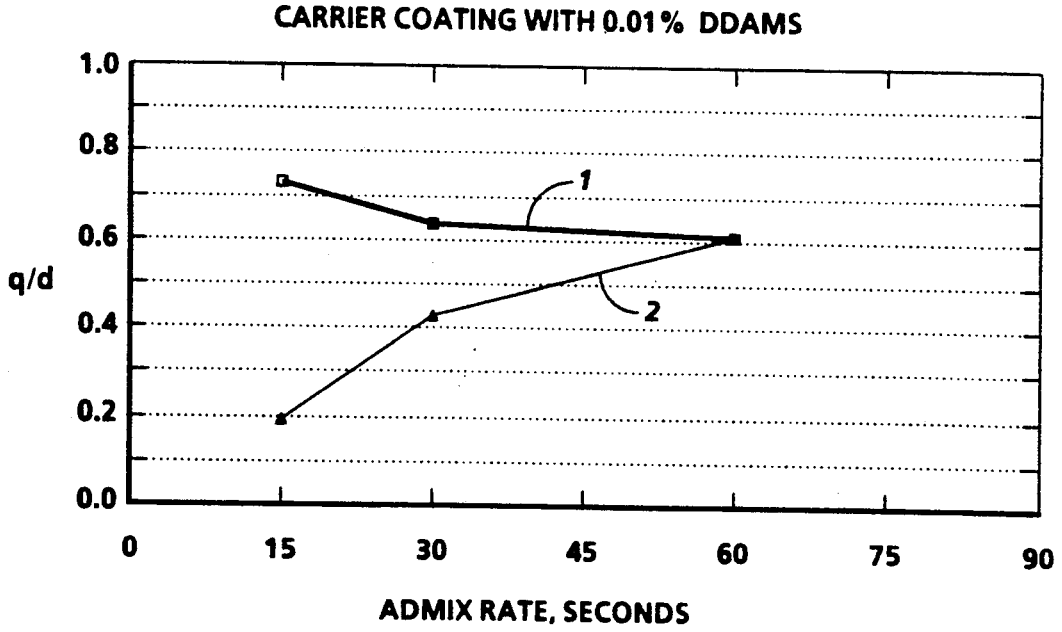

In FIG. 2, there are presented similar line graphs with the exception that the carrier coating has dispersed therein 0.01 percent of distearyl dimethyl ammonium methyl sulfate charge enhancing additive, and the admix rate for freshly substantially uncharged toner, reference line 2, is about 1 minute as is readily determined from the collapsing or meeting of lines 1 and 2. The toner composition selected for FIG. 2, lines 1 and 2, was comprised of the same components as the toner composition of FIG. 1 in the amounts indicated. Accordingly, as can be observed from FIG. 2, reference line 2, the admix rate for substantially uncharged toner approaches 30 seconds rather rapidly, and is equivalent to the admix rate of the composition represented by line 1 in 60 seconds. q/d represents the same characteristics as reported with reference to FIG. 1, and a known charge spectrograph was utilized to measure q/d and the admix rate. The same charge spectrograph was utilized for FIG. 1, lines 1 and 2.

Figure 3:
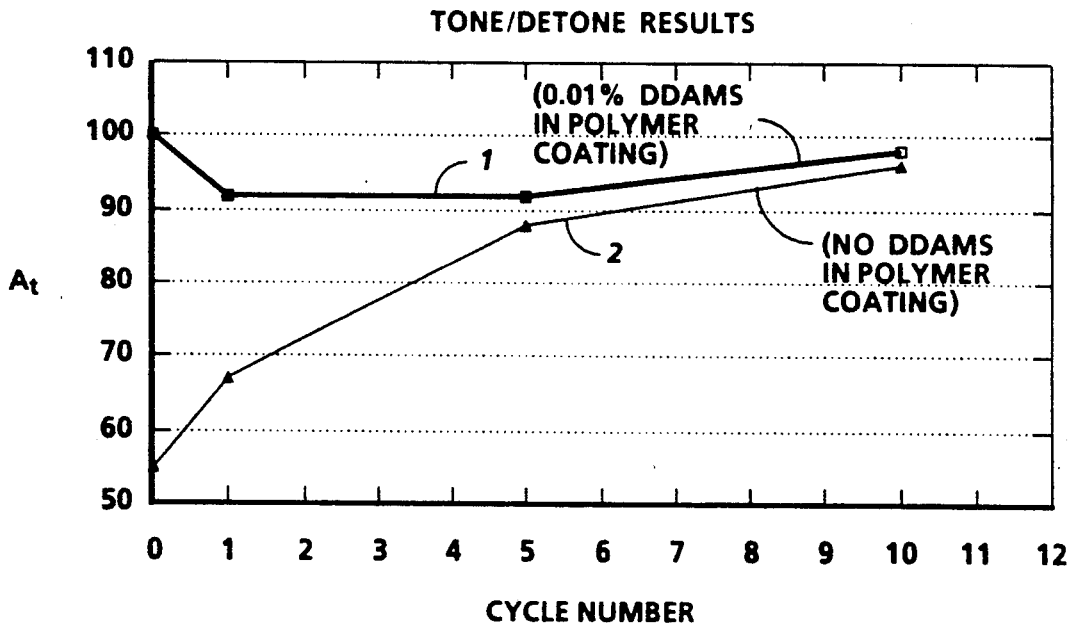
FIG. 3 is a line graph illustrating cycle number versus $A_t$.

FIG. 3 represents tone/detone results for cycle numbers versus $A_t$ wherein line 2 represents measurements for the same developer of FIG. 2 except wherein the carrier does not contain a charge enhancing additive in the polymer coating while in line 1 the carrier includes therein a distearyl dimethyl methyl ammonium sulfate charge enhancing additive in an amount of 0.01 weight percent. With further respect to FIG. 3, $A_t$ as defined herein is measured in a Faraday Cage apparatus and line 1 represents a developer comprised of the same carrier and toner components as detailed with reference to FIG. 2, line 1. For line 2 in FIG. 3, the same developer as selected for line 1 but wherein the carrier coating contains no charge enhancing additive distearyl dimethyl ammonium sulfate is shown. The tone/detone tests were accomplished by blending the prepared, conditioned carrier particles, 97 weight percent, with 3 weight percent of the toner, which blending was accomplished in a paint shaker, for example for about 10 minutes. Thereafter, the carrier is detoned or removed from the toner using a sweeping technique, and the detoned developer or carrier was then retoned or had added thereto 3 percent by weight of the same toner in a paint shaker for 10 minutes. This was classified as cycle 1. The above was repeated for 10 cycles and the tribo toner concentration admix characteristics were measured at 5 and 10 cycles with each cycle representing about 3,000 to about 5,000 images thereby enabling, for example, the determination of the stability of the developer in terms of the tribo, that is the $A_t$. With no charge enhancing additive such as the distearyl dimethyl ammonium methyl sulfate in the carrier coating, reference line 2, FIG. 3, the $A_t$ was substantially undesirably stable beginning with zero cycles and continuing on up to about 10 cycles, while with the DDAMS in the carrier coating, 0.01 weight percent, the $A_t$ or stability of the developer is relatively constant beginning, for example, with 1 carrier cycle and continuing on to 6 with a slight rise to 10 cycle numbers.

Various suitable solid core carrier materials can be selected. Characteristic core properties of importance include those that will enable the toner particles to acquire a positive charge or a negative charge; and carrier cores that will permit desirable flow properties in the developer reservoir present in the xerographic imaging apparatus. Also of value with regard to the carrier core properties are, for example, suitable magnetic characteristics that will permit magnetic brush formation in mag brush development processes; and also wherein the carrier cores possess desirable mechanical aging characteristics. Examples of carrier cores that can be selected include iron, steel, ferrites including copper zinc ferrites, magnetites, nickel, and mixtures thereof. Preferred carrier cores include ferrites, and sponge iron, or steel grit with an average particle size diameter of from between about 30 microns to about 200 microns.

Illustrative examples of polymer coatings, which coatings contain charge enhancing additives as indicated herein, selected for the carrier particles include those that are not in close proximity in the triboelectric series. Specific examples of polymer mixtures used are polyvinylidenefluoride with polyethylene; polymethylmethacrylate and copolyethylenevinylacetate; copolyvinylidenefluoride tetrafluoroethylene and polyethylene; polymethylmethacrylate and copolyethylene vinylacetate; and polymethylmethacrylate and polyvinylidenefluoride; and the like including the polymer mixtures of U.S. Pat. Nos. 4,937,166 and 4,935,326, the disclosures of which are totally incorporated herein by reference. Other related polymer mixtures not specifically mentioned herein may be selected including, for example, polystyrene and tetrafluoroethylene; polyethylene and tetrafluoroethylene; polyethylene and polyvinyl chloride; polyvinyl acetate and tetrafluoroethylene; polyvinyl acetate and polyvinyl chloride; polyvinyl acetate and polystyrene; and polyvinyl acetate and polymethyl methacrylate.

With further reference to the polymer coating mixture, by close proximity as used herein it is meant that the choice of the polymers selected are dictated by their position in the triboelectric series, therefore for example, one may select a first polymer with a significantly lower triboelectric charging value than the second polymer. For example, the triboelectric charge of a steel carrier core with a polyvinylidenefluoride coating is about −75 microcoulombs per gram. However, the same carrier, with the exception that there is selected a coating of polyethylene, has a triboelectric charging value of about −17 microcoulombs per gram. More specifically, not in close proximity refers to first and second polymers that are at different electronic work function values, that is they are not at the same electronic work function value; and further, the first and second polymers are comprised of different components. Additionally, the difference in electronic work functions between the first and second polymer is at least 0.2 electron volt, and preferably is about 2 electron volts; and moreover, it is known that the triboelectric series corresponds to the known electronic work function series for polymers, reference "Electrical Properties of Polymers", Seanor, D. A. Chapter 17, *Polymer Science*, A. D. Jenkins, Editor, North Holland Publishing (1972), the disclosure of which is totally incorporated herein by reference.

The percentage of each polymer present in the carrier coating mixture can vary depending on the specific components selected, the coating weight, and the properties desired. Generally, the coated polymer mixtures used contain from about 10 to about 90 percent of the first polymer, and from about 90 to about 10 percent by weight of the second polymer. Preferably, there are selected mixtures of polymers with from about 40 to 60 percent by weight of the first polymer, and from about 60 to 40 percent by weight of a second polymer. In one embodiment of the present invention, when a high triboelectric charging value is desired, that is, for example, exceeding −50 microcoulombs per gram, there is selected from about 90 percent by weight of the first polymer such as polyvinylidenefluoride, and 10 percent by weight of the second polymer such as polyethylene. In contrast, when a lower triboelectric charging value is required, less than about −20 microcoulombs per gram, there is selected from about 10 percent by weight of the first polymer, and 90 percent by weight of the second polymer. Carrier coating weights are present in an effective amount and are dependent on a number of factors including the polymer selected, however, generally the carrier coating weight is from about 0.1 to about 5 weight percent, and preferably from about 0.5 to about 2 weight percent.

Also, there results, in accordance with an embodiment of the present invention, carrier particles of relatively constant conductivities of from about $10^{-15}$ mho-cm$^{-1}$ to about $10^{-9}$ mho-cm$^{-1}$ at, for example, a 10 volt impact across a 0.1 inch gap containing carrier beads held in place by a magnet; and wherein the carrier particles are of a triboelectric charging value of from −15 microcoulombs per gram to −70 microcoulombs per gram, these parameters being dependent on the coatings selected, and the percentage of each of the polymers used as indicated hereinbefore.

Various effective suitable means can be used to apply the polymer mixture coatings to the surface of the carrier particles. Examples of typical means for this purpose include combining the carrier core material, and the mixture of polymers by cascade roll mixing or tumbling, milling, shaking, electrostatic powder cloud spraying, fluidized bed, electrostatic disc processing, and an electrostatic curtain. Following application of the polymer mixture, heating is initiated to permit flow-out of the coating material over the surface of the carrier core. The concentration of the coating material powder particles, as well as the parameters of the heating step, may be selected to enable the formation of a continuous film of the coating material on the surface of the carrier core, or permit only selected areas of the carrier core to be coated. When selected areas of the metal carrier core remain uncoated or exposed, the carrier particles will possess electrically conductive properties when the core material comprises a metal. The aforementioned conductivities can include various suitable values. Generally, however, this conductivity is from about $10^{-9}$ to about $10^{-17}$ mho-cm$^{-1}$ as measured, for example, across a 0.1 inch magnetic brush at an applied potential of 10 volts; and wherein the coating coverage encompasses from about 10 percent to about 100 percent of the carrier core.

For preconditioning the carrier, there can be selected and mixed with the carrier as indicated herein a number of known charge enhancing additives including alkyl pyridinium halides, reference U.S. Pat. No. 4,298,672, the disclosure of which is totally incorporated herein by reference, distearyl dimethyl ammonium methyl sulfate, reference U.S. Pat. No. 4,560,635, the disclosure of which is totally incorporated herein by reference; other quaternay ammonium salts, organic sulfates and sulfonates such as stearyl phenethyl dimethyl ammonium tosylate, reference U.S. Pat. No. 4,490,455, the disclosure of which is totally incorporated herein by reference; and the like. The charge enhancing additive can be present in various effective amounts depending, for example, on the components selected, preferably, however, from about 0.002 to about 3, and more preferably from about 0.002 to about 0.01 weight percent based on the weight of the polymer coating is selected.

Illustrative examples of finely divided toner resins selected for the developer compositions are polyamides, epoxies, polyurethanes, diolefins, styrene acrylates, styrene methacrylates, vinyl resins and polymeric esterification products of a dicarboxylic acid and a diol comprising a diphenol. Specific vinyl monomers that can be used are styrene, p-chlorostyrene vinyl naphthalene, unsaturated mono-olefins such as ethylene, propylene, butylene and isobutylene; vinyl halides such as vinyl chloride, vinyl bromide, vinyl fluoride, vinyl acetate, vinyl propionate, vinyl benzoate, and vinyl butyrate; vinyl esters like the esters of monocarboxylic acids including methyl acrylate, ethyl acrylate, n-butylacrylate, isobutyl acrylate, dodecyl acrylate, n-octyl acrylate, 2-chloroethyl acrylate, phenyl acrylate, methylalphachloracrylate, methyl methacrylate, ethyl methacrylate, and butyl methacrylate; acrylonitrile, methacrylonitrile, acrylamide, vinyl ethers, inclusive of vinyl methyl ether, vinyl isobutyl ether, and vinyl ethyl ether, vinyl ketones inclusive of vinyl methyl ketone, vinyl hexyl ketone and methyl isopropenyl ketone; vinylidene halides such as vinylidene chloride, and vinylidene chlorofluoride; N-vinyl indole, N-vinyl pyrrolidene; Pliolites ®; styrene butadiene copolymers as illustrated in U.S. Pat. Nos. 4,558,108 and 4,469,770, the disclosures of which are totally incorporated herein by reference; crosslinked resins; mixtures thereof; and other similar substances.

As one preferred toner resin there can be selected the esterification products of a dicarboxylic acid and a diol comprising a diphenol, reference U.S. Pat. No. 3,590,000, the disclosure of which is totally incorporated herein by reference. Other preferred toner resins include styrene/methacrylate copolymers; styrene/-butadiene copolymers; polyester resins obtained from the reaction of bisphenol A and propylene oxide; and branched polyester resins resulting from the reaction of dimethyl terephthalate, 1,3-butanediol, 1,2-propanediol and pentaerythritol.

Generally, from about 1 part to about 5 parts by weight of toner particles are mixed with from about 10 to about 300 parts by weight of the carrier particles prepared in accordance with the process of the present invention.

Numerous well known suitable pigments or dyes can be selected as the colorant for the toner particles including, for example, carbon black, nigrosine dye, lamp black, iron oxides, magnetites, and mixtures thereof. The pigment, which is preferably carbon black, should be present in a sufficient amount to render the toner composition highly colored. Thus, the pigment particles are present in amounts of from about 2 percent by weight to about 20 percent by weight, based on the total weight of the toner composition, however, lesser or greater amounts of pigment particles can be selected.

When the pigment particles are comprised of magnetites, which are a mixture of iron oxides ($FeO.Fe_2O_3$) including those commercially available as Mapico Black, they are present in the toner composition in an amount of from about 10 percent by weight to about 75 percent by weight, and preferably in an amount of from about 20 percent by weight to about 50 percent by weight.

The resin particles are present in a sufficient, but effective amount, thus when 10 percent by weight of pigment or colorant, such as carbon black, is contained therein, about 90 percent by weight of resin material is selected. Preferably, however, the toner composition is comprised of from about 85 percent to about 97 percent by weight of toner resin particles, and from about 3 percent by weight to about 15 percent by weight of pigment particles such as carbon black.

Also encompassed within the scope of the present invention are colored toner compositions comprised of toner resin particles, preconditioned carrier particles, and as pigments or colorants red, blue, green, brown magenta, cyan and/or yellow particles, as well as mixtures thereof. More specifically, illustrative examples of magenta materials that may be selected as pigments include 1,9-dimethyl-substituted quinacridone and anthraquinone dye identified in the Color Index as Cl 60720, Cl Dispersed Red 15, a diazo dye identified in the Color Index as Cl 26050, Cl Solvent Red 19, and the like. Examples of cyan materials that may be used as pigments include copper tetra-4-(octadecyl sulfonamido) phthalocyanine, X-copper phthalocyanine pigment listed in the Color Index as Cl 74160, Cl Pigment Blue, and Anthrathrene Blue, identified in the Color Index as Cl 69810, Special Blue X-2137, and the like; while illustrative examples of yellow pigments that may be selected are diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33, 2,5-dimethoxy-4-sulfonanilide phenylazo-4'-chloro-2,5-dimethoxy aceto-acetanilide, Permanent Yellow FGL, and the like. These pigments are generally present in the toner composition in an amount of from about 1 weight percent to about 15 weight percent based on the weight of the toner resin particles.

For further enhancing the positive charging characteristics of the toner compositions described herein and as optional components, there can be incorporated in the toner charge enhancing additives inclusive of alkyl pyridinium halides, reference U.S. Pat. No. 4,298,672, the disclosure of which is totally incorporated herein by reference; organic sulfate or sulfonate compositions, reference U.S. Pat. No. 4,338,390, the disclosure of which is totally incorporated herein by reference; distearyl dimethyl ammonium sulfate; the charge additives of U.S. Pat. No. 4,937,157 and copending application U.S. Ser. No. 396,497, the disclosures of each of these applications being totally incorporated herein by reference; and other similar known charge enhancing additives. These additives are usually incorporated into the toner in an amount of from about 0.1 percent by weight to about 20 percent by weight, and preferably from about 0.1 to about 3 weight percent.

The toner composition of the present invention can be prepared by a number of known methods including melt blending the toner resin particles, and pigment particles or colorants of the present invention followed by mechanical attrition. Other methods include those well known in the art such as spray drying, melt dispersion, dispersion polymerization and suspension polymerization. In one dispersion polymerization method, a solvent dispersion of the resin particles and the pigment particles are spray dried under controlled conditions to result in the desired product.

Also, the toner and developer compositions of the present invention may be selected for use in electrostatographic imaging processes containing therein conventional photoreceptors, including inorganic and organic photoreceptor imaging members. Examples of imaging members are selenium, selenium alloys, and selenium or selenium alloys containing therein additives or dopants such as halogens. Furthermore, there may be selected organic photoreceptors, illustrative examples of which include layered photoresponsive devices comprised of transport layers and photogenerating layers, reference U.S. Pat. No. 4,265,990, the disclosure of which is totally incorporated herein by reference, and other similar layered photoresponsive devices. Examples of generating layers include trigonal selenium, metal phthalocyanines, metal free phthalocyanines and vanadyl phthalocyanines. As charge transport molecules, there can be selected the aryl diamines disclosed in the '990 patent. Also, there can be selected as photogenerating pigments squaraine compounds, thiapyrillium materials, and the like. These layered members are conventionally charged negatively thus usually requiring a positively charged toner. Moreover, the developer compositions of the present invention are particularly useful in electrostatographic imaging processes and apparatuses wherein there is selected a moving transporting means and a moving charging means; and wherein there is selected a deflected flexible layered imaging member, reference U.S. Pat. Nos. 4,394,429 and 4,368,970, the disclosures of which are totally incorporated herein by reference.

With further reference to the process for generating the carrier particles illustrated herein, in an embodiment there is initially obtained, usually from commercial sources, the uncoated carrier core and the polymer powder mixture coating. The individual components for the coating are available, for example, from Pennwalt as 301F Kynar, Allied Chemical as Polymist B6, and other sources. Generally, these polymers are blended in various proportions as mentioned herein, for example, in a ratio of 1 to 1, 0.1 to 0.9, and 0.5 to 0.5 with the charge additive. The blending can be accomplished by numerous known methods including, for example, a twin shell mixing apparatus. Thereafter, the carrier core polymer blend is incorporated into a mixing apparatus in an amount of about 1 percent by weight of the powder to the core, and 0.002 to 0.01 percent by weight of the charge additive distearyl dimethyl ammonium methyl sulfate in a preferred embodiment, and mixing is affected for a sufficient period of time until the preconditioned polymer blend is uniformly distributed over the carrier core, and mechanically or electrostatically attached thereto. Subsequently, the resulting treated coated carrier particles are metered into a rotating tube furnace, which is maintained at a sufficient temperature to cause melting and fusing of the polymer blend with charge additive to the carrier core.

The following examples are being supplied to further define the present invention, it being noted that these examples are intended to illustrate and not limit the scope of the present invention. Parts and percentages are by weight unless otherwise indicated. Tone/detone tests were accomplished as indicated herein and, for example, by blending the prepared conditioned carrier product, 97 weight percent, with 3 weight percent of the toner of FIG. 3 in a paint shaker for 10 minutes. Thereafter, the carrier is detoned or removed from the toner using a sweeping technique, that is by utilizing a stream of air. The detoned carrier was then retoned, or had added thereto 3 percent by weight of toner in a paint shaker for 10 minutes. This was classified as cycle number 1. The above was repeated for 10 cycles, and the tribo and the toner concentration were measured at 5 cycles and 10 cycles, respectively. Each cycle represents about 3,000 to about 5,000 imaging cycles in a xerographic imaging test fixture.

EXAMPLE I

There was prepared preconditioned carrier particles by coating 68,040 grams of a Toniolo atomized steel core, 120 microns in diameter, with 680 grams of a polyvinylidenefluoride, available as Kynar 301F, 1 percent coating weight, and 0.01 weight percent of distearyl dimethyl ammonium methyl sulfate by mixing these components for 60 minutes in a Munson MX-1 Minimixer rotating at 27.5 RPM. There resulted uniformly distributed and electrostatically attached, as determined by visual observation, on the carrier core the polyvinylidenefluoride with the distearyl dimethyl ammonium methyl sulfate initially dispersed therein. Thereafter, the resulting carrier particles were metered into a rotating tube furnace at a rate of 105 grams/minute. This furnace was maintained at a temperature of 403° F. thereby causing the treated polymer to melt and fuse to the core.

A developer composition was then prepared by mixing 97.5 grams of the above prepared treated carrier particles with 2.5 grams of a toner composition comprised of 92 percent by weight of a styrene n-butylmethacrylate copolymer resin, 58 percent by weight of styrene, 42 percent by weight of n-butylmethacrylate, 10 percent by weight of carbon black, and 2 percent by weight of the charge additive cetyl pyridinium chloride. Thereafter, the triboelectric charge on the carrier particles was determined by the known Faraday Cage process, and there was measured on the carrier a charge of 25 microcoulombs per gram. Further, the conductivity of the carrier, as determined by forming a 0.1 inch long magnetic brush of the carrier particles, and measuring the conductivity by imposing a 10 volt potential across the brush, was $10^{-15}$ mho-cm$^{-1}$.

EXAMPLE II

The procedure of Example I was repeated with the exception that 102.0 grams, 0.15 percent coating weight, of polyvinylfluoride was used. There resulted on the carrier particles a triboelectric charge thereon of 23 microcoulombs per gram. Also, the carrier particles had a conductivity of $10^{-9}$ mho-cm$^{-1}$. Thus, these particles are considered conductive. Therefore, by changing the coating weight from 1 percent to 0.15 percent, there is a significant conductivity change, that is, the carrier particles are converted from being insulating, reference Example I, to being conductive. Also, the triboelectric value for this carrier increased from −68.3 to −33.7.

EXAMPLE III

A developer composition was prepared by repeating the procedure of Example I with the exception that there were selected as the carrier coating 680 grams of a polymer blend at a 0.7 weight percent coating weight of a polymer mixture, ratio 1:9 of polyvinylidenefluoride, Kynar 301F, and polyethylene, available as Polymist B6 from Allied Chemical, and the toner indicated hereinafter. There resulted on the carrier particles a triboelectric charge of −17.6 microcoulombs per gram. Also, the carrier particles were insulating in that they had a conductivity of $10^{-15}$ mho-cm$^{-1}$.

Therefore, there results carrier particles that are insulating and with a relatively low tribo, namely −17.6 microcoulombs per gram.

With the above developer containing 0.01 percent by weight of distearyl dimethyl ammonium methyl sulfate, the admix mix rate in seconds versus q/d is represented in FIG. 2, line 1, wherein the toner was comprised of a suspension polymerized styrene butadiene, 80.13 percent (89/11), carbon black, 3.15 percent, 16.4 weight percent of magnetite and 0.32 weight percent of distearyl dimethyl ammonium methyl sulfate; and wherein the developer was prepared by adding 3 parts by weight of the above prepared toner (3 percent toner concentration) per 97 parts by weight of the above prepared carrier with a polymer blend thereover, and containing the distearyl dimethyl ammonium methyl sulfate charge enhancing additive therein. The admix rate, reference line 2, of substantially uncharged toner comprised of the same components in the same amounts of the aforementioned toner, collapses at 60 seconds. Also, the $A_t$ versus cycle numbers and tone/detone results are presented in FIG. 3 for the same developers with 0.01 percent by weight of the charge enhancing additive distearyl dimethyl ammonium methyl sulfate in the carrier coating, reference line 1, and with no distearyl dimethyl ammonium methyl sulfate present in the polymer coating, reference line 2.

EXAMPLE IV

A developer composition was prepared by repeating the procedure of Example III with the exception that there was selected as the carrier coating a polymer mixture, ratio 9:1, of polyvinylidenefluoride, Kynar 301F, and polyethylene, available as Polymist B6. About 680 grams of the polymer blend, that is a 1.0 percent coating weight, was selected. There resulted on the carrier particles a triboelectric charge of −63 microcoulombs per gram, and the insulating carrier particles had a conductivity of $10^{-15}$ mho-cm$^{-1}$.

Therefore, for example, in comparison to the developer of Example III with a polymer blend ratio of 9 to 1, instead of 1 to 9, there was obtained insulating toner particles with a higher negative triboelectric charge, namely −63 microcoulombs per gram as compared to −17.6 microcoulombs per gram with reference to the developer of Example III.

With the above developer, it is believed that substantially similar $A_t$ and admix time characteristics will result as that reported in Example III, reference FIGS. 2 and 3.

EXAMPLE V

A developer composition was prepared by repeating the procedure of Example III with the exception that there was selected as the carrier coating a blend, ratio 3:2, of a polymer mixture of polyvinylidenefluoride, Kynar 301F, and high density 10.962 grams/milliliters of polyethylene FA520, available from USI Chemical Company, 0.5 weight percent. About 340 grams of the polymer blend, that is a 0.5 percent coating weight, was added. There resulted on the carrier particles a triboelectric charge of −29.8 microcoulombs per gram. Also, the resulting insulating carrier particles had a conductivity of $10^{-14}$ mho-cm$^{-1}$.

The admix rate in seconds versus q/d and $A_t$ for the above prepared developer, and substantially uncharged replenishment toner particles were substantially similar to the compositions as reported in FIGS. 2 and 3.

EXAMPLE VI

A developer composition was prepared by repeating the procedure of Example III with the exception that there was selected as the carrier coating a blend, ratio 7:3, of a polymer mixture of copolyvinylidenefluoride tetrafluoroethylene, available from Pennwalt as Kynar 7201, and a high density, 0.962 grams per milliliter, of polyethylene available as Microthene FA520 from USI Chemicals Company. About 272 grams of the polymer blend, that is a 0.4 percent coating weight, was added. There resulted on the carrier particles a triboelectric charge of −47.6 microcoulombs per gram. Also, the resulting insulating carrier particles had a conductivity of $10^{-14}$ mho-cm$^{-1}$.

The admix rate in seconds versus q/d and $A_t$ for the above prepared developer, and substantially uncharged replenishment toner particles were substantially similar to the compositions as reported in FIGS. 2 and 3.

EXAMPLE VII

A developer composition was prepared by repeating the procedure of Example VI with the exception that there was selected as the carrier coating a blend, ratio 7:3, a polymer mixture of copolyvinylidenefluoride tetrafluoroethylene, available from Pennwalt as Kynar 7201, and a low density, 0.924 grams per milliliter, polyethylene available from USI Chemicals Company as FN510. About 476 grams of the polymer blend, that is a 0.7 percent coating weight, was added. There resulted on the carrier particles a triboelectric charge of −42 microcoulombs per gram. Also, the resulting insulating carrier particles had a conductivity of $10^{-15}$ mho-cm$^{-1}$.

The admix rate in seconds versus q/d and $A_t$ for the above prepared developer, and substantially uncharged replenishment toner particles were substantially similar to the compositions as reported in FIGS. 2 and 3.

EXAMPLE VIII

A developer composition was prepared by repeating the procedure of Example IV with the exception that there was selected as the carrier coating a blend, ratio 7:3, of a polymer mixture of Kynar 7201, and a copolyethylene vinylacetate, available from USI Chemical Company as FE532. About 476 grams of the polymer blend, that is a 0.7 percent coating weight, was added. There resulted on the carrier particles a triboelectric charge of −33.7 microcoulombs per gram. Also, the resulting insulating carrier particles had a conductivity of $10^{-15}$ mho-cm$^{-1}$.

The admix rate in seconds versus q/d and $A_t$ for the above prepared developer, and substantially uncharged replenishment toner particles were substantially similar to the compositions as reported in FIGS. 2 and 3.

EXAMPLE IX

A developer composition was prepared by repeating the procedure of Example VIII with the exception that there was selected as the carrier coating a blend, ratio of 2:3, of a polymer mixture of a polyvinylidenefluoride available from Pennwalt as Kynar 301F, and a polymethacrylate available from Fuji Xerox. About 476 grams of the polymer blend, that is a 0.7 percent coating weight, was added. There resulted on the carrier particles a triboelectric charge of −29.5 microcoulombs per gram. Also, the resulting insulating carrier particles had a conductivity of $10^{-15}$ mho-cm$^{-1}$.

The admix rate in seconds versus q/d and $A_t$ for the above prepared developer, and substantially uncharged replenishment toner particles were substantially similar to the compositions as reported in FIGS. 2 and 3.

With further reference to the above Examples, the conductivity values were obtained as indicated herein. Specifically, these values were generated by the formation of a magnetic brush with the prepared carrier particles. The brush was present within a one electrode cell consisting of the magnet as one electrode and a nonmagnetic steel surface as the opposite electrode. A gap of 0.100 inch was maintained between the two electrodes and a 10 volt bias was applied in this gap. The resulting current through the brush was recorded and the conductivity is calculated based on the measured current and geometry. More specifically, the conductivity in mho-cm$^{-1}$ is the product of the current, and the thickness of the brush, about 0.254 centimeters, divided by the product of the applied voltage and the effective electrode area.

With insulating developers, there are usually obtained images of high copy quality with respect to both lines and halftones, however, solid areas are of substantially lower quality. In contrast, with conductive developers there are achieved enhanced solid areas with low line resolution and inferior halftones.

With respect to the triboelectric numbers in microcoulombs per gram, they were determined by placing the developer materials in an 8 oz. glass jar with 2.75 percent by weight of the toner compositions. Subsequently, the aforementioned developers were placed on a Red Devil Paint Shaker and agitated for 10 minutes. Subsequently, the jar was removed and samples from the jar were placed in a known tribo Faraday Cage apparatus. The blow off tribo of the carrier particles was then measured.

EXAMPLE X

The procedure of Example I was repeated with the exceptions that 297.8 grams of Kynar, 189.6 grams of polymethacrylate, and 3.6 grams of distearyl dimethyl ammonium methyl sulfate were mixed in the laboratory blender MSR for 4 minutes; the blender speed was 415 rpm; and 150 pounds of a steel carrier core. There resulted after mixing the aforementioned components with 150 pounds of a steel carrier core at 0.705 weight percent for 30 minutes, followed by processing the resulting components in a rotary kiln of 7 inches diameter and at 400° F. carrier particles comprised of a steel core with a coating thereover comprised of Kynar 40 weight percent, polymethacrylate, 60 weight percent, and 0.005 weight percent of distearyl dimethyl ammonium methyl sulfate.

The admix rate in seconds versus q/d and $A_t$ for the above prepared developer, and substantially uncharged replenishment toner particles were substantially similar to the compositions as reported in FIGS. 2 and 3.

EXAMPLE XI

The processes of Example X were repeated with the exceptions that in a high intensity mixer 428 grams of the mixture of polymers were blended with 135 pounds of the carrier steel core in the Munson blender for 30 minutes. Mixing was ceased and 6.12 grams, 0.01 weight percent, of distearyl dimethyl ammonium methyl sulfate was then added to the aforementioned blender, followed by additional blending for 10 minutes. Subsequently, fusing of the polymer DDAMS mixture to the steel carrier core was accomplished in a rotary kiln.

EXAMPLE XII

The processes of Example XI was repeated with the exceptions that 30 weight percent of Kynar and 70 weight percent of polymethacrylate were selected, and substantially similar results were obtained.

Other modifications of the present invention may occur to those skilled in the art subsequent to a review of the present application. These modifications including equivalents thereof are intended to be included within the scope of the present invention.

What is claimed is:

1. A process for the preparation of carrier particles consisting essentially of (1) mixing carrier cores with a polymer mixture comprising from about 10 to about 90 percent by weight of a first polymer, and from about 90 to about 10 percent by weight of a second polymer, and from about 0.002 to about 0.2 weight percent of charge enhancing additives; (2) dry mixing the carrier core particles and the aforementioned preconditioned polymer mixture for a sufficient period of time enabling the polymer mixture to adhere to the carrier core particles; (3) heating the mixture of carrier core particles and polymer mixture with charge additive to a temperature of between about 200° F. and about 550° F., whereby the polymer mixture with charge enhancing additive melts and fuses to the carrier core particles; and (4) thereafter cooling the resulting coated carrier particles, wherein the first polymer and second polymer are not in close proximity thereto in the triboelectric series, and wherein the charge enhancing additive is selected from the group consisting of alkyl pyridinium halides, organic sulfate and sulfonate compositions, and distearyl dimethyl ammonium methyl sulfate, which charge additive is present in the polymer coating surface.

2. A process in accordance with claim 1 wherein the carrier core is steel.

3. A process in accordance with claim 1 wherein the carrier core is selected from the group consisting of iron and ferrites.

4. A process in accordance with claim 1 wherein the polymer mixture selected is comprised of from about 40 percent by weight to about 60 percent by weight of the first polymer, and from about 60 percent by weight to about 40 percent by weight of the second polymer.

5. A process in accordance with claim 1 wherein the resulting carrier particles are of a conductivity of from about $10^{-6}$ mho-cm$^{-1}$ to about $10^{-17}$ mho-cm$^{-1}$.

6. A process in accordance with claim 1 wherein the triboelectric charging value of the resulting carrier particles is from about −5 microcoulombs per gram to about −80 microcoulombs per gram.

7. A process in accordance with claim 1 wherein the coating is continuous, and is present in a thickness of from about 0.2 micron to about 1.5 microns.

8. A process in accordance with claim 1 wherein the polymer mixture is heated for a period of from about 10 minutes to about 60 minutes.

9. A process in accordance with claim 1 wherein the carrier core is nickel.

10. A process in accordance with claim 1 wherein the carrier core particles have an average particle diameter of between about 30 microns and about 1,000 microns.

11. A process for the preparation of carrier particles consisting essentially of (1) mixing carrier cores with a polymer mixture comprising from about 10 to about 90 percent by weight of a first polymer, and from about 90 to about 10 percent by weight of a second polymer, and from about 0.002 to about 0.2 weight percent of charge enhancing additives; (2) dry mixing the carrier core particles and the aforementioned preconditioned polymer mixture of (1) for a sufficient period of time enabling the polymer mixture to adhere to the carrier core particles; (3) heating the mixture of carrier core particles and polymer mixture with charge additive to a temperature of between about 200° F. and about 550° F., whereby the polymer mixture with charge enhancing additive melts and fuses to the carrier core particles; and (4) thereafter cooling the resulting coated carrier particles, wherein the first polymer and second polymer are not in close proximity thereto in the triboelectric series, the improvement residing in the addition of a charge enhancing additive selected from the group consisting of alkyl pyridinium halides, organic sulfate and sulfonate compositions, and distearyl dimethyl ammonium methyl sulfate, which additive is present in the polymer coating surface.

12. A process in accordance with claim 11 wherein the charge enhancing additive is distearyl dimethyl ammonium methyl sulfate.

* * * * *